United States Patent [19]

Knight et al.

[11] Patent Number: 4,720,909

[45] Date of Patent: Jan. 26, 1988

[54] METHOD OF MANUFACTURING MINIATURE POWER SWITCHING RELAYS

[75] Inventors: Michael W. Knight, Fort Branch; Paul G. Feil, Evansville, both of Ind.

[73] Assignee: AMF Inc., White Plains, N.Y.

[21] Appl. No.: 830,117

[22] Filed: Feb. 18, 1986

Related U.S. Application Data

[62] Division of Ser. No. 546,860, Oct. 31, 1983, Pat. No. 4,596,972.

[51] Int. Cl.[4] ..... H01H 49/00

[52] U.S. Cl. ..... 29/606; 29/602 R

[58] Field of Search ..... 29/602 R, 606

[56] References Cited

U.S. PATENT DOCUMENTS

| | | | |
|---|---|---|---|
| Re. 27,891 | 1/1974 | Davis | 336/192 |
| 2,180,420 | 11/1939 | Larsen | 175/21 |
| 2,500,748 | 3/1950 | Grant | 175/21 |
| 3,230,489 | 1/1966 | Weyrich | 336/192 |
| 3,238,485 | 3/1966 | Litchfield et al. | 336/198 |
| 3,308,407 | 3/1967 | Lake | 335/128 |
| 3,436,574 | 4/1969 | Larsson | 310/194 |
| 3,525,965 | 8/1970 | Sparling | 336/198 |
| 3,566,465 | 3/1971 | Weiner | 29/628 |
| 3,599,322 | 8/1971 | Parker | 29/594 |
| 3,688,395 | 9/1972 | Cummings | 29/606 X |
| 3,717,829 | 2/1973 | Flaherty | 335/187 |
| 3,739,312 | 6/1973 | Knebel | 336/192 |
| 3,786,562 | 1/1974 | Ciszewski | 29/602 |
| 3,893,194 | 7/1975 | Hayden et al. | 335/202 |
| 3,940,722 | 11/1974 | Fox et al. | 335/151 |
| 4,112,400 | 9/1978 | Jaidinger et al. | 335/128 |
| 4,223,370 | 9/1980 | Quere et al. | 361/331 |
| 4,227,162 | 10/1980 | Fujita et al. | 335/202 |
| 4,267,540 | 5/1981 | Iketani | 335/128 |
| 4,318,069 | 3/1982 | Morse | 336/192 |
| 4,320,369 | 3/1982 | Bukala | 335/202 |
| 4,365,223 | 12/1982 | Fechant et al. | 335/281 |
| 4,400,761 | 8/1983 | Hayden et al. | 361/400 |
| 4,596,972 | 6/1986 | Knight et al. | 335/128 X |

OTHER PUBLICATIONS

Hall, D. A., Ritter, J. M., Wustrau, R., Coil Assembly, IBM Technical Disclosure Bulletin, vol. 23, No. 5, p. 1740, 10/1980.

*Primary Examiner*—Howard N. Goldberg
*Assistant Examiner*—Taylor J. Ross
*Attorney, Agent, or Firm*—John Francis Moran

[57] ABSTRACT

An improved power-switching relay especially designed for mounting on printed circuit boards together with a method for manufacturing such a relay. The relay includes a number of features designed to properly position the various relay components relative to one another and to help ensure that they remain in the proper position at all times. To this end, the relay includes a unitary bobbin (22) and stationary contact support header (33) together with means (64) for firmly retaining the stationary contacts (34, 36) and their terminals (63, 73) in place in the header. The relay also provides means to prevent rotation of the armature relative to the movable contact assembly (53, 54) and to prevent rotation of the coil assembly relative to the frame (35). According to a further aspect of the invention, the core and coil assembly is attached to the relay frame by extending the core through the coil assembly and press-fitting the core into an extruded hole (14) in the frame. This procedure not only provides a very strong, rigid attachment, but permits the core to be accurately positioned relative to the movable contact arm assembly by simply pressing the core into the extruded aperture by the required amount. This capability, for the most part, eliminates the need for any final adjustments after the relay has been assembled and, thus, helps reduce manufacturing costs. The bobbin is additionally provided with deformable members (38) to take up any space between the core head and bobbin, ensuring a tight assembly.

10 Claims, 13 Drawing Figures

METHOD OF MANUFACTURING MINIATURE POWER SWITCHING RELAYS

This application is a division of application Ser. No. 546,860, filed Oct. 31, 1983, now U.S. Pat. No. 4,596,972.

TECHNICAL FIELD

The present invention relates generally to the field of electromechanical relays and, more particularly, to a miniature power switching relay specifically designed for mounting on printed circuit boards, as well as to an improved method for manufacturing such a relay.

BACKGROUND ART

Although electromechanical switching devices, commonly referred to as relays, have been used for many years, there is a continuing need for such a device which is small in size, yet capable of reliably handling relatively high current switching jobs. This requirement for miniaturization together with reliability has become particularly important in recent years because of the increasingly common practice of mounting relays on printed circuit boards.

In the design of an electrical relay, and other such electromechanical devices, a most important consideration is the design of the "magnetic circuit." The design of an effective magnetic circuit determines to a great extent the current switching capability of the relay and the power needed to operate it. The magnetic circuit of a relay generally includes the core of the relay coil, the relay frame, the armature that moves the relay contacts, and the air gaps that exist where the core of the relay coil and the armature interface with the relay frame and most importantly between the armature and the core of the coil.

In relay operation, an electrical current through the relay coil sets up a magnetic field in this magnetic circuit; and it is the strength of the magnetic field in the air gap between the armature and the core of the relay coil that moves the armature into contact with the core of the relay coil, thus providing the motion to operate the switching contacts of the relay. In the relay, the core of the relay coil, the frame, and armature are all materials easily magnetized, such as steel. The air gaps, however, present a high reluctance, i.e., impedance to the establishment of the magnetic field; and the air gap between the armature and the core of the coil has by far the most significant reluctance in the magnetic circuit. In obtaining switching capability for the relay, it is desirable to design for effective contact travel distances and rapid movement of the contacts by the armature. It is also desirable to provide the strongest possible magnetic field at this armature gap for the available relay current to provide for positive and rapid contact movement and to permit the use of a strong spring for return movement of the armature when the relay current is stopped, also for positive and rapid contact movement.

Thus, the mechanical arrangement of the magnetic coil core and relay armature and resulting air gap and the design of their interfaces significantly affect the ability of the relay to perform its function as an electrical switching device. It is desirable to reduce any air gap between the core of the relay coil and the relay frame to a minimum, provided, of course, that the relay can be manufactured at a cost consistent with its intended application and market. At the closable air gap between the movable armature and the core of the coil, however, there is the problem of providing an air gap of sufficient length to provide an effective switching and circuit breaking capability for the relay contacts and of providing an air gap short enough for low magnetic reluctance and a strong magnetic field for operating effectively, in conjunction with the relay spring, the switching function of the relay.

As in other fields, there is also a continuing effort to find ways to reduce the cost of manufacturing relays. In the prior art, this has been difficult to achieve to any meaningful extent because most existing manufacturing procedures require a significant amount of human participation, especially in connection with the usually necessary step of finally adjusting the positions of the various relay components with respect to one another after the relay has been assembled to ensure effective switching and efficient operation of the relay.

Specifically, in the prior art, the core of the relay is usually fastened to the relay base or frame by staking or some similar procedure in which the position of the core relative to the frame is essentially preset by the nature of the fastening operation and is incapable of being adjusted either during or after the fastening procedure. Accordingly, in order to correct for overshoot of the movable contact arm and, in particular, to assure correct positioning of the armature relative to the core and of the movable contact button relative to the stationary contact members, it is usually necessary to manually bend or twist the spring that supports the armature and the movable contact button to some extent after the relay has been assembled.

A relay design and manufacturing process that achieves correct positioning of the various relay components with respect to one another substantially automatically with minimal operator participation would provide a meaningful reduction in manufacturing costs, and be of significant value.

DISCLOSURE OF THE INVENTION

In accordance with the present invention, a relay construction is provided which, in conjunction with a novel method for manufacturing the relay, permits the relay to be assembled substantially automatically with all relay components in their correct relative positions, and which, once assembled is designed to ensure that the components remain properly positioned.

According to one aspect of the invention, the relay frame, core, and coil assembly are assembled together as a unit by extending the core through the coil assembly and press-fitting the core into an extruded aperture in the frame which has a diameter that is slightly less than that of the core. The resulting interference fit between the core and the walls of the extruded aperture provides a consistently tight, stable assembly that is effective in retaining the components together in their correct positions without any additional fastening operation being necessary.

A particularly important characteristic of the press-fitting operation is that it permits the core to be accurately positioned relative to the armature position during the initial assembly of the relay by simply pressing the core into the extruded aperture in the frame to the proper level. In most cases, this capability eliminates the need for final adjustment of the relay.

Another feature of the relay is that the bobbin and the stationary contact supporting header are constructed as an integral, one-piece element to locate the stationary contacts very accurately in their correct position. In this regard, also, the stationary contacts are provided with terminal portions which extend through slots in the contact header and which are formed with a plurality of barbs which act to grab the walls of the slots to help retain the terminals, and the contact members in general, tightly in position.

The invention also provides a means for preventing rotation between the movable contact arm and the armature as well as structure for preventing relative rotation between the bobbin and the frame. Also, the spring length between the armature and the movable contact button has been reduced relative to prior art relays resulting in an increase in the contact pressure between the movable contact and the stationary contacts as well as less contact bounce. This feature is a major reason for the relatively high electrical load switching capability of the relay.

Yet further features and important advantages of the invention will become apparent during the following description of the best modes for carrying out the invention taken in conjunction with the drawings:

BEST MODES FOR CARRYING OUT THE INVENTION

Figure 3:
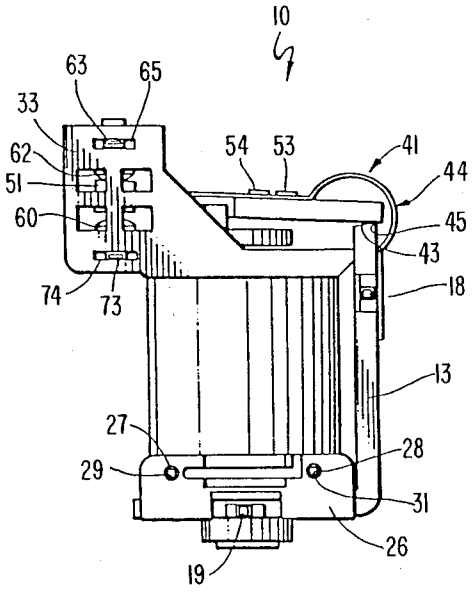
FIG. 3 illustrates a back view of the relay of FIG. 1.
Figure 2:
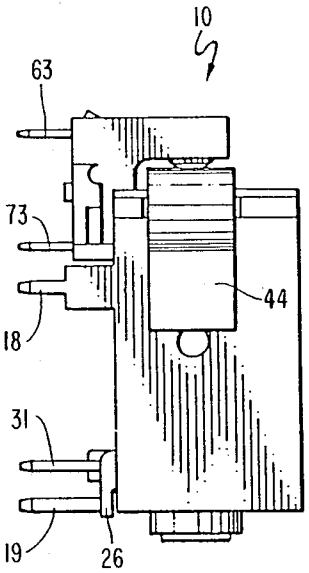
FIG. 2 illustrates a side view of the relay of FIG. 1 looking in the direction of arrows 2—2 in FIG. 1.
Figure 1:
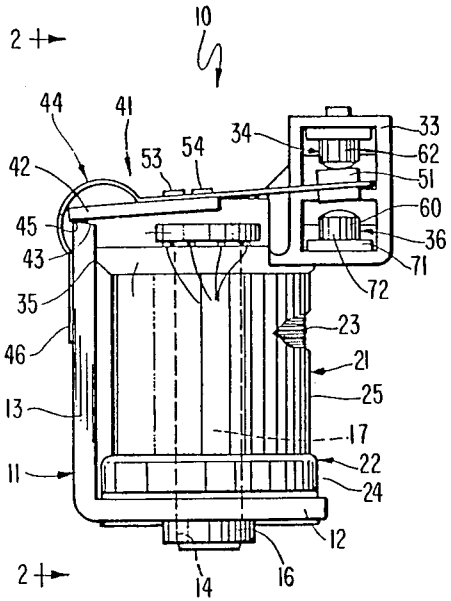
FIG. 1 illustrates, somewhat schematically, a relay according to a presently preferred embodiment of the invention, with portions of the relay being cut away to better illustrate specific features thereof.

FIGS. 1–3 illustrate front, side, and rear views, respectively, of a relay according to a presently preferred embodiment of the invention. The relay as a whole is generally designated by reference number 10 and includes a frame 11 which comprises a generally rectangular-shaped plate bent at substantially a right angle to define a base portion 12 and a side portion 13. Frame 11 is constructed of steel or other appropriate electrically conductive material, and is preferably also provided with a very thin coating of copper or the like to enhance its conductivity. In the presently most preferred embodiment, for example, frame 11 comprises a 0.1575 cm. thick cold-rolled steel plate having a copper-plated coating 15 (see FIG. 9) of from about 0.00038 cm. to about 0.00076 cm. thick.

Base 12 defines a centrally located aperture 14 that extends completely through the base and is adapted to receive and support the core 17 of the relay. As will be discussed more fully hereinafter, aperture 14 is preferably formed by an extrusion process to define a downwardly extending annular extrusion 16 (shown more clearly in FIG. 9).

As can be seen in FIGS. 2 and 3, terminals 18 and 19 extend from the side and base portions, respectively, of the frame and are preferably formed integral with the frame. Terminals 18 and 19 both function as common terminals for the relay and, in addition, serve to provide balancing anchoring points to mechanically secure the relay to a printed circuit board. Terminal 19, in particular, also serves to provide mechanical strain relief for the coil terminals of the relay to help protect against accidental damage to the coil terminals or to the coil itself.

Supported on frame 11 is a coil assembly 21 which includes a bobbin 22 and a coil 23 of conventional construction wound around the bobbin. Preferably also, the coil is covered with a suitable insulating tape or film 25 as is known in the art. The coil assembly 21 is supported on frame 11 by core 17 which is adapted to extend through a central tubular-shaped aperture 37 in the bobbin 22 (see FIG. 4) and be press-fit into aperture 14 in the frame to rigidly hold the assembly in position.

Figure 4:
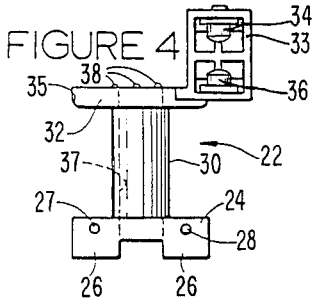
FIG. 4 illustrates the bobbin incorporated within the relay of FIGS. 1–3.

The bobbin itself is illustrated in FIG. 4 and is formed of a suitable electrically insulating material, which, in the presently preferred embodiment, comprises a nylon resin impregnated with about 33% by weight of glass. Structurally, the bobbin includes a stem portion 30 around which coil 23 is adapted to be wound and upper and lower rim portions 32 and 24, respectively. The lower rim portion 24 is formed to have downwardly turned flange portions 26 which are sized and shaped to extend over one edge of the bottom portion 12 of frame 11 and are also provided with a pair of apertures 27 and 28 through which the coil terminals 29 and 31 are adapted to extend (see FIGS. 2 and 3).

One side of the upper rim portion 32 of bobbin 22 is provided with an upwardly extending contact header portion 33, preferably formed integral with the bobbin and provided to support the stationary, contact members 34 and 36. This unitary or monolithic bobbin/contact header construction is an important feature of the present invention in that it helps to ensure accurate positioning of the stationary contact members relative to the other components of the relay both during and after their assembly.

Upper rim portion 32 of bobbin 22 is also provided with a flat edge 35 on its side opposite the contact header. This flat is positioned to be in contact with the sidewall 13 of frame 11 and acts to prevent rotation of the bobbin (and the coil assembly in general) relative to the frame. This ensures accurate positioning of the bobbin and integral contact header relative to the frame and relative to the movable contact arm assembly mounted thereon.

Finally, the bobbin is provided with several "crush bumps" 38 on its top surface which are located to be positioned under the head 39 of the core 17 (FIG. 1). As will be amplified on hereinafter, these "crush bumps" allow the core to be pressed into aperture 14 in base 12 to the correct position relative to the frame and stationary contact positions.

Figure 5:
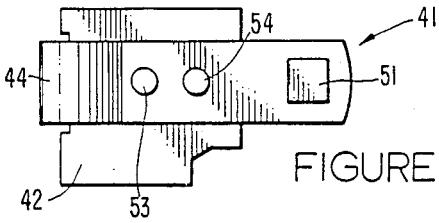
FIGS. 5 and 6 illustrate top and side views, respectively, of the movable contact arm assembly utilized in the relay of FIGS. 1–3.
Figure 6:
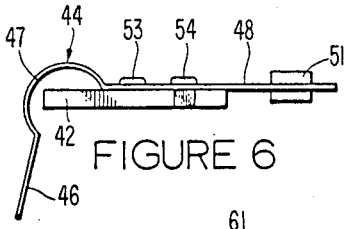
Figure 10:
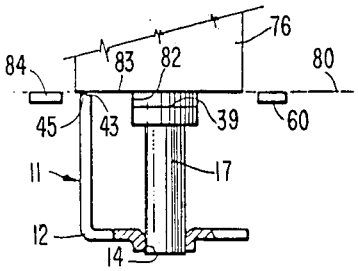
FIG. 10 schematically illustrates a procedure for press-fitting the core into the relay frame.

Referring back to FIGS. 1–3, the relay also includes a movable contact arm assembly 41 which is shown more clearly in FIGS. 5 and 6 which illustrate top and side views, respectively, of the assembly. As shown, the assembly includes a flat spring member 44 which is shaped to include: a first, substantially flat portion 46 spot welded or otherwise electrically coupled to the side portion 13 of the frame; a second curved portion 47; and a third flat portion 48 which is adapted to support an armature 42 and a movable contact button 51.

The armature 42 comprises a flat steel plate that is pivotally supported on the upper end 43 of side portion 13 of the frame (FIG. 1). In particular, armature 42 is pivotally supported on an outer edge 45 of end 43 defined by the downwardly and inwardly sloping surface of end 43, and is mounted to spring 44 by a pair of rivets 53 and 54. By providing the second rivet 54 adjacent the front edge of the armature (most prior art devices employ only one rivet), the cantilever length between the rivet 54 and the contact button 51 is reduced. This results in a higher contact pressure and less contact bounce between the movable and stationary contact buttons which not only helps to extend relay life, but also, to a significant extent, is responsible for the high electrical load-switching capability of the relay. In addition, the utilization of two spaced rivets serves to prevent any rotation of the armature relative to the spring 44.

Figure 7:
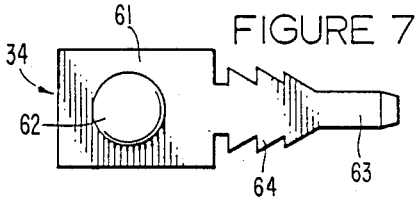
FIGS. 7 and 8 illustrate top and side views, respectively, of a stationary contact member utilized in the relay of FIGS. 1–3.
Figure 8:
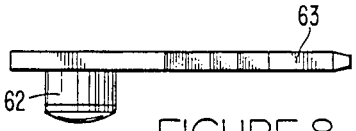

A further important feature of the present invention relates to the manner in which the fixed contact members 34 and 36 are secured in position within contact header 33. Specifically, FIGS. 7 and 8 illustrate top and side views, respectively, of upper, stationary contact member 34. As can be seen, the member includes a generally rectangular portion 61 supporting a contact button 62, and an extended terminal portion 63. Terminal portion 63 is adapted to extend through a slot 65 formed in the back wall of contact header 33 as is shown most clearly in FIG. 3. As illustrated in FIG. 7, terminal portion 63 is provided with a plurality of barbs 64 which act to "grab" the walls of the slot 65 and, in this way, help retain the terminal and the contact member 34 in general, tightly in position to prevent any dislocation of the contact member relative to the header either horizontally or vertically.

The bottom stationary contact member 36 is similar in construction to contact member 34 and thus is not described in detail herein. Suffice it to say that it too includes a barbed terminal portion 73 which extends through a slot 74 in the contact header 33 as shown in FIG. 3.

To complete the structure of the relay, although it has not been shown in the drawings, a cover of suitable insulating material may be provided to enclose and protect the relay. Since such covers are well-known in the art, and since the cover used to enclose the above-described relay does not form a part of the present invention, it is not believed to be necessary to describe it herein.

As indicated previously, the relay according to the present invention was particularly designed for use on printed circuit boards. Accordingly, it is quite compact in size with the preferred embodiment having a height of about 3.0 cms., a width of about 2.34 cms., and a depth (except for extending terminals) of about 1.65 cms. Notwithstanding this small size, however, the relay has been shown to be fully effective in handling loads of up to 30 amps at 240 volts A.C.

Under normal conditions, spring 44 will bias the movable contact button 51 into contact with button 62 of upper, normally closed, stationary contact member 34. When the coil 23 is energized, however, the armature 42 will be attracted downwardly against the now magnetized head 39 of core 17; and the movable contact button 51 will be carried downwardly away from member 34 and into contact with button 60 of normally open contact member 36. When the coil is de-energized, the armature will be released by the core 17 and the movable contact button will be returned back to its original position by spring 44.

As alluded to previously, a very important feature of the present invention relates to the manner in which the relay is manufactured. Specifically, in accordance with the invention, the coil assembly (including the bobbin 22 with attached contact header 33), the core 17 and the frame 11, are all mounted together as a rigid unit by extending the core through central opening 37 in the bobbin and press-fitting the core into extruded aperture 14 in the base portion 12 of frame 11.

In the prior art, the core is conventionally secured to the relay frame by staking or by some other comparable operation in which the position of the core relative to the frame is essentially preset by the nature of the operation and is incapable of being changed or adjusted. Therefore, if the position of the armature is not quite right relative to the core head, it has traditionally been the practice to somewhat bend or twist the armature supporting spring 44 by hand as a final adjustment after the relay has been substantially fully assembled. This additional manual step is inefficient and increases the cost of manufacturing the relay.

In accordance with the present invention, this additional "final adjustment38 step has, for the most part, been eliminated from the manufacturing process.

Figure 9:
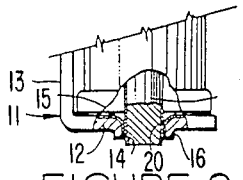
FIG. 9 is a partial cross-sectional view of the bottom portion of the relay of FIG. 1 illustrating the press-fit relationship between the relay frame and the core.

FIG. 9 illustrates a partial cross-sectional view of the bottom portion of the relay as is shown in FIG. 1. Specifically, a section of the bottom portion 12 of frame 11 has been cut away to show core 17 being supported within aperture 14 in the base of frame 11. According to a presently preferred embodiment, aperture 14 is formed by a conventional extrusion process to define a downwardly extending annular flange 16 of, perhaps, 0.2286 cm. in depth and about 0.0813 cm. thick. The inside diameter of the aperture is about 0.4763 cm. and although not clearly visible in the Figures, in forming, is preferably provided with a very slight downwardly and inwardly extending taper of about 1°.

The core 17, which is preferably formed with an electroplated nickel coating 20 (see FIG. 9) about 0.0076 cm. thick, has a diameter of about 0.4851 cm., which is slightly larger than the inside diameter of the aperture 14, so that there will be an interference fit between the core and the wall of the aperture.

In operation, the frame 11 is supported on an appropriate fixture and the core is press-fit into the aperture 14 by any appropriate tool such as a one-ton press 76 which can be an air press, a screw press, or any other appropriate tool known in the art. The tool is designed to drive the core into the aperture 14 to just the correct depth so that the top surface of the core head 39 will be a precise distance below a reference plane 80 defined by the frame seat 43 and the upper surface of the lower, normally open stationary contact button 60. In the preferred embodiment, the core should be about 0.0178 cm. below this plane.

Attainment of this correct position can be achieved in several ways. One convenient technique is to form the head of the press 76 with a step 82 positioned above the frame seat. The step is dimensioned such that when the surface 83 of the tool head just touches the frame seat, the core will be at the correct position and the press will stop. A proximity sensor 84 is preferably provided to detect when the tool head just touches the frame to stop further action of the press. With the above system, a positioning accuracy of ±0.0013 cm. has been found to be attainable.

Alternatively, an electronic vision system could be used to detect the correct position of the core head.

Figure 11:
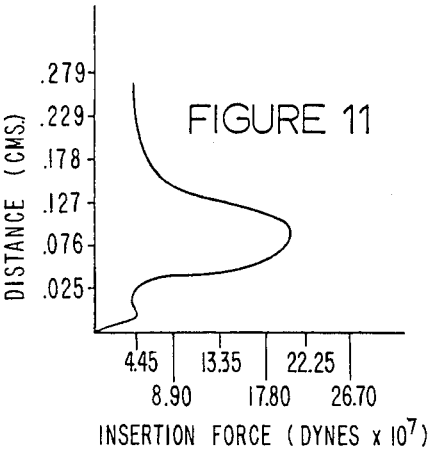
FIGS. 11 and 12 illustrate typical insertion and extraction force curves, respectively, for a core which is press-fit into a relay frame according to the teachings of the present invention.
Figure 12:
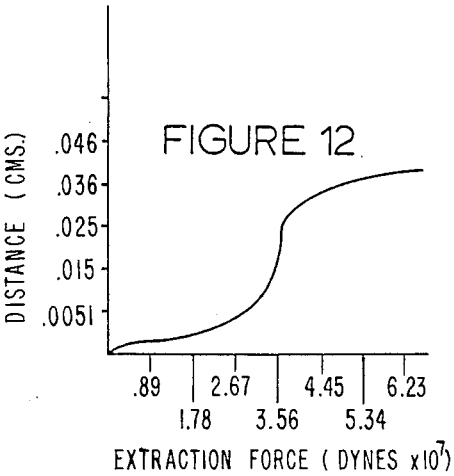

As the core is inserted into the aperture, it will compress the frame material defining the aperture and will provide an extremely tight fit that will maintain the core in the correct position against all forces likely to be encountered by the relay. FIGS. 11 and 12 illustrate typical force curves for the insertion and extraction, respectively, of a 0.4851 cm. diameter core into an extruded hole having a diameter of 0.4763 cm. Both elements were plated as indicated previously. The insertion force in FIG. 11 was exerted downwardly on the core while the extraction force of FIG. 12 was exerted upwardly on the core. As can be seen from FIG. 12, a substantial amount of force is needed to move the core even very slightly, more force than is ever likely to be encountered by the relay.

As mentioned previously, the bobbin 22 is provided with a plurality of "crush bumps" 38 (see FIGS. 1 and 4) under the core head position. These crush bumps are adapted to deform as the core is pressed down into the correct position relative to the frame and stationary contact member to permit the core to be correctly positioned without disturbing the relative position of any other part of the bobbin while, at the same time, guaranteeing a tight assembly between the core and the bobbin. Without the crush bumps, correct positioning of the core could result in a space being left between the core head and the upper surface of the bobbin which would allow the bobbin to slide up and down on the core or, alternatively, could permit the core to be pressed down on the body of the bobbin itself deforming it and possibly damaging the surrounding coil or altering the positions of the stationary contacts by deforming the contact header 33 which is integral with the bobbin.

The bumps are preferably formed integral with the bobbin and may be shaped and arranged in various ways. In the presently most preferred embodiment, the bumps are three in number and about 0.05 cm. high, and are formed in the shape of mounds narrower at their top than at their base. Most preferably, the inner half of each mound is cut away when the internal aperture 37 is bored out to leave three "half" mounds which have been found to provide just the correct amount of resistance to the core as it is being pressed into the frame such that they will be deformed by about one-half their height during a typical press-fit operation.

Instead of the crush bumps, an annular deformable rim or other shape could be formed on the bobbin if desired. Alternatively, a separate deformable element, such as a spring or other member, could be provided and positioned between the core head and the top surface of the bobbin. It would also be possible to provide deformable means between the bottom of the bobbin and the frame 11 although, in practice, this does not provide as good results.

It has been found that the press-fit method according to the present invention eliminates the need to adjust most relays after assembly. Because the bobbin and stationary contact supporting header are constructed as one piece, there will never be any relative movement of these elements either during or after the press-fitting operation. One advantage of the invention, in fact, is that the press-fitting operation permits the bobbin and stationary contact support structure to be integral with one another. In the prior art, it was often necessary to design the relay to permit the stationary contacts to be adjusted as part of the "final adjustment" of the relay to assure proper operation of the relay.

The interference fit between the frame and the core at the extruded hole in the frame ensures a consistently tight, stable assembly. The core retaining forces are high in both axial directions relative to the core and there is a higher retention force than is typical in the lateral direction as well. The core is also self-aligning in the direction of the hole with this procedure. Although it would not normally be necessary, it is possible, if desired for extra protection, to further attach the core to the frame by staking or any other appropriate means in addition to the press-fit attachment.

It has also been found that there is actually an overall improvement in the magnetic circuit due to a reduction in the reluctance at the core/frame interface.

Figure 13:
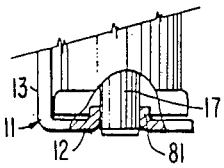
FIG. 13 is a partial cross-sectional view of the bottom portion of an alternative embodiment of a relay according to the present invention.

FIG. 13 illustrates an alternative embodiment of the invention. FIG. 13 differs from FIG. 9 only in that extrusion 81 extends upwardly in the direction opposite the direction of insertion of the core rather than downwardly in the same direction as the direction of insertion of the core. It has been found that this embodiment provides substantially similar results as the embodiment of FIG. 9.

It has been found that pressing the core into an extruded hole provides a somewhat higher retaining force than pressing the core into a non-extruded hole although it is intended that the present invention cover such a method as well.

Although not essential and not clearly visible in the Figures, it is desirable to taper the core 17 very slightly (by, for example 1°–2°) in order to help reduce shearing effects between the core and the walls of the aperture. This helps to provide a more predictable expansion and tightening as the core insertion progresses. The taper must be small enough to prevent movement due to thermal expansion yet large enough to maintain tightness.

While what has been described constitutes presently preferred embodiments of the invention, it should be recognized that the invention may take many other forms. For example,the concept of press-fitting the core into an extruded aperture in the frame can readily find application in the manufacture of many other electromagnetic devices such as solenoid valves, circuit breakers, and the like in addition to relays.

Because many changes can be made without departing from the spirit and scope of the invention and without diminishing its attendant advantages, it is intended that such changes and modifications be covered by the following claims.

We claim:

1. A method for manufacturing relays which includes the step of attaching a core member to a core-supporting member, characterized in that said method further includes the step of extending said core member through a coil assembly comprising a non-conductive bobbin and a coil wound around said bobbin, and further characterized in that said attaching step comprises the step of thereafter press-fitting said core member and said coil assembly positioned thereon a selected distance into core-receiving means in said core-supporting member for mounting said core member and coil assembly thereon to said core-supporting member and for positioning said core member and said coil assembly relative to other components of said relay.

2. A method as recited in claim 1 characterized in that said core member has a first diameter and said core-receiving means has a second diameter which is less than said first diameter, and further characterized in that said press-fitting step comprises the step of press-fitting said core member into said core-receiving means to establish an interference fit between said core member and said core-receiving means.

3. A method as recited in claim 1 characterized in that said core-receiving means comprises an aperture in said core-supporting member and said method further includes the step of forming said aperture with an annular flange therearound, and further characterized in that said press-fitting step comprises press fitting said core member a selected distance into said aperture.

4. A method as recited in claim 3 and further characterized in that said core-supporting member comprises a frame, said relay further includes an armature pivotally supported on an edge of said frame and said bobbin includes stationary contact means, and further characterized in that said press-fitting step comprises press-fitting said core member into said aperture a selected distance to properly align said core member with said edge of said frame and said stationary contact means.

5. A method for manufacturing relays which includes a frame including an armature-supporting edge, a magnetic core to be carried by said frame, an armature to be pivotally supported on said edge of said frame to carry and move electrical contact means, and a coil assembly to surround said core, said coil assembly including a bobbin having a portion carrying a coil and a portion carrying stationary contact means, characterized by the steps of extending said core through said coil assembly so said core is carried by said coil assembly and thereafter press fitting said core into an aperture in said frame a selected distance to properly align said core and said stationary contact means with said edge of said frame.

6. A method as recited in claim 5 characterized by the step of providing said aperture with an annular flange therearound for receipt of said core.

7. A method as recited in claim 5 characterized in that said coil assembly includes a crushable portion of a resilient material and said crushable portion is deformed as said core is pressed into said aperture to hold the coil assembly and stationary contact means carried thereby in position upon assembly .

8. A method as set forth in claim 5 characterized in that said frame, magnetic core and the coil assembly are simultaneously fastened together and positioned with the top of the core a precise distance below a reference plane defined by said edge of the frame and a surface of said stationary contact means.

9. A method as recited in claim 8 characterized in that said positioning and fastening is effected automatically by a press and a fixture establishing the reference plane.

10. A method as recited in claim 8 characterized in that said positioning and fastening is effected by a press including a portion adapted to engage the top of said core, and the motion of said press is stopped by a proximity sensor as the press reaches the proper position.

* * * * *